US006571497B1

(12) United States Patent
Aylward et al.

(10) Patent No.: US 6,571,497 B1
(45) Date of Patent: Jun. 3, 2003

(54) DAY/NIGHT COMPOSITE IMAGING MEMBER

(75) Inventors: Peter T. Aylward, Hilton, NY (US); Robert P. Bourdelais, Pittsford, NY (US); Alphonse D. Camp, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/515,148

(22) Filed: Feb. 29, 2000

(51) Int. Cl.[7] ..... G09F 19/00

(52) U.S. Cl. ..... 40/615; 399/22; 399/15; 430/9; 430/15

(58) Field of Search ..... 40/615; 399/22, 399/502, 15; 430/9, 15

(56) References Cited

U.S. PATENT DOCUMENTS

| | | | | |
|---|---|---|---|---|
| 4,019,937 A | | 4/1977 | Holson | |
| 4,263,357 A | | 4/1981 | Holson | |
| 4,934,739 A | | 6/1990 | Stancato | |
| 5,144,328 A | * | 9/1992 | Blake et al. | 346/1.1 |
| 5,242,522 A | | 9/1993 | Moir | |
| 5,518,561 A | * | 5/1996 | Rosa | 156/71 |
| 5,866,282 A | | 2/1999 | Bourdelais et al. | |
| 6,030,756 A | | 2/2000 | Bourdelais et al. | |
| 6,063,552 A | | 5/2000 | Bourdelais et al. | |
| 6,074,788 A | | 6/2000 | Bourdelais et al. | |
| 6,083,669 A | * | 7/2000 | Bourdelais et al. | 430/363 |
| 6,093,521 A | * | 7/2000 | Laney et al. | 430/363 |

* cited by examiner

*Primary Examiner*—Lynne H. Browne
*Assistant Examiner*—James M. Hewitt
(74) *Attorney, Agent, or Firm*—Paul A. Leipold

(57) ABSTRACT

An imaging element including in order an upper image, at least one transmission and reflection device providing optical transmission of between 35% and 55%, and a lower image, wherein at least the upper and lower images are on separate supports.

33 Claims, 1 Drawing Sheet

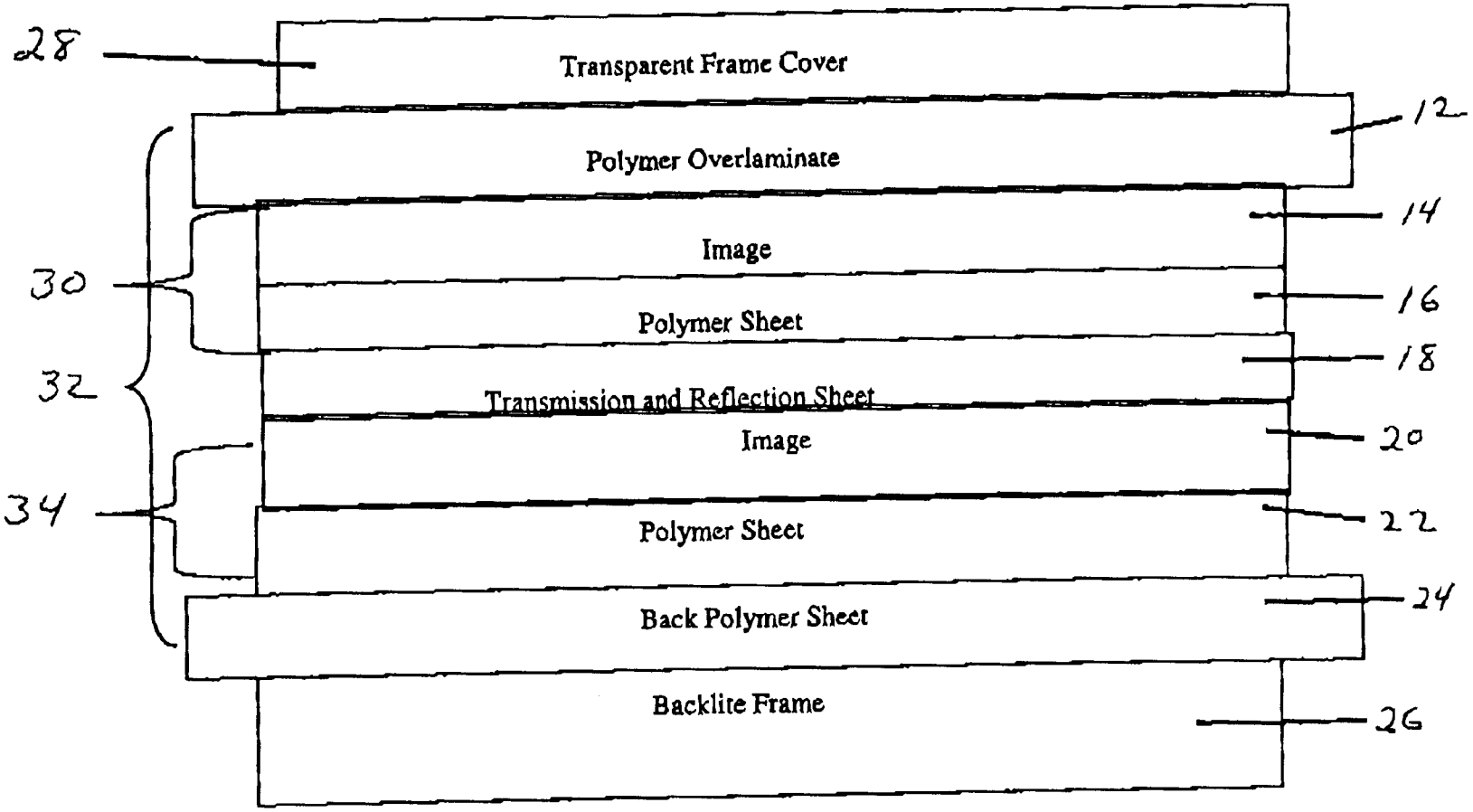
Transparent Frame Cover
Polymer Overlaminate
Image
Polymer Sheet
Transmission and Reflection Sheet
Image
Polymer Sheet
Back Polymer Sheet
Backlite Frame
12
14
16
18
20
22
24
26
28
30
32
34

DAY/NIGHT COMPOSITE IMAGING MEMBER

FIELD OF THE INVENTION

This invention relates to photographic materials. In the preferred form it relates to base materials for photographic display and portraits.

BACKGROUND OF THE INVENTION

It is known in the art that photographic display materials are utilized for advertising, as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters, and fine art photography. The desired attributes of a quality, high impact photographic display material are a slight blue density minimum, durability, sharpness, and flatness. Cost is also important, as display materials tend to be expensive compared with alternative display material technology, mainly lithographic images on paper. For display materials, traditional color paper is undesirable, as it suffers from a lack of durability for the handling, photoprocessing, and display of large format images.

Prior art photographic transmission display materials with incorporated diffusers have light sensitive silver halide emulsions coated directly onto a gelatin coated clear polyester sheet. Incorporated diffusers are necessary to diffuse the light source used to backlight transmission display materials. Without a diffuser, the light source would reduce the quality of the image. Typically, white pigments are coated in the bottommost layer of the imaging layers. Since light sensitive silver halide emulsions tend to be yellow because of the gelatin used as a binder for photographic emulsions, minimum density areas of a developed image will tend to appear yellow. A yellow white reduces the commercial value of a transmission display material because the imaging viewing public associates image quality with whiter whites. The transmission property of this imaged support is very good but typically the dye density is higher than a reflection display material in order to prevent the image from being washed out by the backlights. With the higher dye density, the image appears to be very dark and over-saturated, making it a non-usable material. Prior art photographic reflection display materials have light sensitive silver halide emulsions coated directly onto a gelatin coated pigmented polyester sheet. The reflective display material provides a somewhat pleasing image when viewed with reflective light but the transmission quality in not acceptable because of the high opacity of the base. It would be desirable if a transmission display material with an incorporated diffuser could have a more blue white, as this is perceived as preferred.

Prior art photographic display materials historically have been classified as either reflective or transmission. Reflective display materials typically are highly pigmented image supports with a light sensitive silver halide coating applied. Reflective display materials are typically used in commercial applications where an image is used to convey an idea or message. An application example of a reflective display material is product advertisement in a public area. Prior art reflective display materials have been optimized to provide a pleasing image using reflective light. Transmission display materials are used in commercial imaging applications and are typically backlit with a light source. Transmission display materials are typically a clear support with an incorporated diffuser coated with a light sensitive silver halide emulsion. Prior art transmission display materials have been optimized to provide a pleasing image when the image is backlit with a variety of light sources. Because prior art reflective and transmission products have been optimized to be either a reflection display image or a transmission display image, two separate product designs must exist in manufacturing and two inventories of display materials must be maintained at the commercial printer. Further, when the quality of the backlighting for transmission display material is reduced when, for example, a backlight burns out or the output of the backlight decreases with the age, the transmission image will appear dark and reduce the commercial value of the image. It would be desirable if an image support could function both as a reflection and transmission display material.

Prior art transmission display materials use a high coverage of light sensitive silver halide emulsion to increase the density of the image compared to photographic reflective print materials. While increasing the coverage does increase the density of the image in transmission space, the time to image development is also increased as the coverage increases. Typically, a high-density transmission display material has a developer time of 110 seconds compared to a developer time of 45 seconds or less for photographic print materials. Prior art high-density transmission display materials, when processed, reduce the productivity of the development lab. Further, coating a high coverage of emulsion requires additional drying of the emulsion in manufacturing reducing the productivity of emulsion coating machines. It would be desirable if a transmission display material was high in density and had a developer time less than 50 seconds.

Prior art photographic transmission display materials, while providing excellent image quality, tend to be expensive when compared with other quality imaging technologies such as ink jet imaging, thermal dye transfer imaging, and gravure printing. Since photographic transmission display materials require an additional imaging processing step compared to alternate quality imaging systems, the cost of a transmission photographic display can be higher than other quality imaging systems. The processing equipment investment required to process photographic transmission display materials also requires consumers to typically interface with a commercial processing lab increasing time to image. It would be desirable if a high quality transmission display support could utilize nonphotographic quality imaging technologies.

Photographic reflection/transmission display materials have considerable consumer appeal, as they allow images to be printed on high quality support for home or small business use. Consumer use of photographic display materials generally has been cost prohibitive since consumers typically do not have the required volume to justify the use of such materials. It would be desirable if a high quality reflection/transmission display material could be used in the home without a significant investment in equipment to print the image such as laser digital photographic printers.

PROBLEM TO BE SOLVED BY THE INVENTION

There is a continuing need for an improved product that will present a bright reflective image when viewed directly and also provide a sharp bright image when backlit.

SUMMARY OF THE INVENTION

It is an object of the invention to overcome disadvantages of prior display materials.

It is another object to provide a superior, lower cost, and stronger display material.

It is a further object to provide a day/night display material that utilizes conventional optical photographic imaging technology.

It is another object to provide a day/night display material that utilizes nonphotographic imaging technology.

These and other objects of the invention are accomplished by an imaging element comprising in order an upper image, at least one transmission and reflection device providing optical transmission of between 35 to 55%, and a lower image, wherein at least the upper and lower images are on separate supports.

ADVANTAGEOUS EFFECT OF THE INVENTION

The invention provides a material that will when imaged will result in a bright sharp reflective image, as well as allowing for backlighting of the image to also result in a clear sharp image in low light situations. The invention further provides a simple means of forming a day/night image using any means of imparting indica on a media.

BRIEF DESCRIPTION OF THE DRAWING

The FIGURE is an illustration of the imaging member of the invention.

DETAILED DESCRIPTION OF THE INVENTION

The invention has numerous advantages over prior practices in the art. The display material of the invention can be used in the home as digital printing technology such as ink jet printing can be used to apply a high quality image to the support. The time to image is less than digital photographic systems, as small jobs can be quickly printed using optical exposures and then photoprocessing. The material of the invention provides a transmission/reflection display material allowing for a wider range of applications utilizing just one material. Both nonphotographic imaging systems as well as optical and digital photographic systems may be used are used to image the support. Furthermore any means of imparting indicia on a substrate may be used to create an acceptable day night image without excessive registration problems in getting an image on both sides of a substrate. Typical examples include inkjet printing, thermal dye sublimation, electrophotographic, optical and digital optical photographic, flexographic and other printing means. The FIGURE is a representation of a mechanically assembled picture in a backlite picture frame. The transparent frame cover 28 overlays and is adjacent to the polymer overlaminate 12 of the composite picture element 32. The image 14 may be formed by a variety of methods such as exposed and developed photosensitive silver halide, inkjet, thermal dye sublimation, electrophotographic or other means. The image is made before the overlamination step. The image is supported by a polymer sheet 16. The upper image 14 and supporting polymer sheet 16 form the upper imaging element 30. A transmission and reflection sheet 18 is placed under the upper imaging element. A separate lower image 20 on a polymer sheet 22, which together form the lower imaging element 34, is placed under the transmission and reflection device. Polymer sheet 24 below the lower imaging element 34 and upper overlaminate sheet 12 on top of imaging element 30 are heat or adhesively sealed to each other to hold the upper imaging element 30 and lower imaging element 34 in register. The composite assembled picture 32 is placed into backlite frame 26 and a transparent frame cover 28 holds the picture in the frame. When the image is viewed with backlighting a very pleasing and balanced image is seen. When the backlight is turned off and the image is viewed with only reflected light, a very pleasing and well-balanced image is seen.

The terms as used herein, "top", "upper", "imaging side", and "face" mean the side or toward the side that carries the image of an individual imaging element or the side or towards the side of a composite picture element that carries the image that is viewed in reflection. The terms "bottom", "lower side", and "back" mean the side or toward the side of the individual imaging elements that is opposite the side carrying the image or the side or towards the side of the composite picture element that is furthest away from the side that carries the image viewed in reflection. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-D}*100$ where D is the average of the red, green, and blue Status A transmission density response measured by an X-Rite model 310 (or comparable) photographic transmission densitometer.

The imaging element of this invention is a composite member which consist of in order an upper image, at least one transmission and reflection device with an optical transmission of between 35% to 55% and a lower image, where the upper and lower images are on separate supports. The transmission and reflection device may comprise a separate sheet from either the upper or lower image or may be part of the either the upper or lower image. In one preferred embodiment the transmission and reflection device may comprise at least one voided polymer sheet. Voids are preferred because they are diffusive but tend to minimize or eliminate light scattering that cause the image to be fuzzy and milky in appearance. In an additional embodiment of this invention at least one transmission and reflective device contains pigments. Pigments are desirable because of their reflective qualities. In general they are readily available and are cheap to incorporate into a polymer sheet. In the most preferred embodiment of this invention said transmission and reflective device comprises voids and pigments. Within this embodiment it is preferred to have a multi-layer sheet in which the pigments are closest to the top image and the voids are below the pigmented layer. The pigmented layer provides reflective properties to the transmission and reflective device to optimize reflective viewing of the image while the voids provide a high degree of diffusion to prevent the image from being washed out during transmission viewing. The images of said imaging element may be formed by inkjet, thermal imaging, electrophotographic or optically exposed silver halide. The image formed by silver halide may be either black and white developed silver or color forming dyes. Any method of image exposure may be used. This includes conventional light devices such as tungsten or incandescent bulbs or by a collimated beam of light from a laser or CRT exposure. In another embodiment the image may be formed by any method of imparting indicia on a support. This includes lithographic, flexographic, gravure printing as well as drawing. The image may be of pictorial and or text composition. The upper and lower images may be formed by the same method or by a combination of methods. In one preferred embodiment the upper image and the lower image are the same image and are in register with each other. When such an imaging element is viewed in reflected light a very pleasing image is present. When said imaging element is viewed by transmission light, a bright, clear and desirable image is seen. In a further embodiment the upper image is different than the lower image.

In an additional embodiment the imaging element of this invention has the upper image on a substantially transparent support. The image layer may be on the top most part or close to the viewer or it may be lower most part of the support containing the image. In a further embodiment the lower image of the imaging element of this invention is on a substantially transparent support. In this case the image layer of the lower imaged support may be to or bottom of said lower imaged support. In the embodiment wherein the upper and the lower images are on separate substantially transparent support, the transmission and reflection device is a separate sheet. In the case where the upper and lower images are identical, the transmission and reflection device is placed between the two images and the images are brought into register with each other to assure that the composite image is sharp.

Another means to form a day/night imaging element of this invention is to provide the upper image on the transmission and reflective device or support. In this imaging element the composite image may be formed with as few as two preferred members. In the preferred form of this embodiment, the upper image is on an upper transmission and reflection device and the lower image is on a substantially clear support. This format is preferred because it only uses two support members and furthermore it is desirable to have a reflective surface near the upper image to provide an optimum in reflective viewing. In the embodiment where both the upper and lower images are separate substantially transparent supports the transmission and reflection device is located between the two transparent supports. In all these embodiment it is desirable to hold the said upper, lower and at least one transmission device together. In the formation of composite day/night images there are many combinations of transmission and reflection devices with and without substantially transparent supports. Whatever the combination, it is desirable to have the optical transmission between 35 and 55% of the assembled picture element.

An additional embodiment of this invention comprises an imaging element with an upper image on a transmission and reflective device and a lower image on a separate transmission and reflective device. In this embodiment the imaged assembled picture element's optical transmission should be between 35% and 55%. An advantage of this system is that only two sheets of support are needed to form the day night image. Furthermore only one type of support media can be used which allows the stocking of only one support versus multiple materials.

Other embodiments of this invention place a substantially transparent layer between the upper and lower image. The added substantially transparent layer provides a spacer that adds depth to the overall composite image. It should be noted that since multiple sheets of support are being used, it is important to bring the images into register. It is generally desirable to hold the imaged members together so they do not move and lose register. This is important because the composite image would look fuzzy and undesirable if the images are not in alignment. A further embodiment of this invention is to fuse the image supports and reflection and transmission device together. This is also true if additional spacers are used. By fusing the supports together, a customer can more easily place the composite picture in a frame or backlite device. Having been fused the images will stay in register and resist going out of register caused by vibrations and/or handling. Another means of holding the imaged supports and the reflection and transmission devices in register is by crimping. By applying mechanical pressure and effectively embossing an interlocking pattern between the various sheets, the composite imaging element can be held together to maintain register of the images. A further embodiment is to maintain register by adhesively connecting the image supports and the reflection and transmission device. The adhesive may either be a permanent or repositionable adhesive. Either clear or pigmented adhesives may be used. When using pigmented adhesive, the overall transmission and reflection properties of the composite imaging element should be maintained. A combination of clear and pigmented adhesive may be used. The adhesive may also be heat activated or chemically activated in a two part adhesive system or used in combination with mechanical pressure or crimping which provides an interlocking surface.

An additional embodiment of this invention is to hold the image support and the reflection and transmission device together and in register by placing them in a tight-fitting transparent container. A tight-fitting container may be a two-sided overlamination where the edges of the overlaminates are sealed by pressure and/or heat. In this method, the individual imaged members cannot move and go out of register because they are held place by the overlaminates. Another method of forming a tight-fitting transparent is to heat shrink material around the composite imaged members. An additional method to hold the imaged elements in register is to use repositionable adhesives between the imaged members and the reflective diffusion member. This is a preferred embodiment because it allows the imaging finishing area to pre-assemble the composite imaging element into a holding device that can be moved from display device to display device without lose of registration. By using a container the images are further protected and may be sealed from environmental conditions.

In the field of imaging display whether in a commercial application or for home use, having the ability to control the final colorimetery of the imaging element is important. In a preferred embodiment the transmission and reflection device may contain tinting agents and or optical brighteners. The tinting agents are used to help offset and baseline color from the image layer or the support members. This is done to provide a more pleasing neutral white. The tinting agents may be added to achieve warm or cold tones or to impart and overall color to the imaging element. Optical brighteners are added to provide added whiteness to the image.

In the formation of a transmission and reflection device, a variety of materials may be used. One embodiment of this invention is to use paper that has the desired reflection and transmission properties. Paper is preferred because of its low cost and availability. A further embodiment is to use glass or plastic. The clear glass as well as plastic may be frosted to create the diffusion and reflection properties. A layer of chemical may be applied by coated or sprayed on the surface or material, including pigments and dyes, to form the diffusion properties as an integral part of the glass or plastic. A preferred embodiment of a reflective diffusive member is to provide a thin polymer sheet comprising voids and/or white pigment. Said embodiment is preferred because the at least one image layer may further be attached to the thin polymer sheet.

In a preferred embodiment of this invention the method of forming an imaging element is to bring an upper image and at least one transmission and reflection device with an optical transmission of between 35 and 55% and a lower image which is on a different support than the upper image into register and to secure them together. This method is preferred because it is a simple and quick process to bring the images into register. Bringing the images into register may be done manually or by mechanical or optical means by adjusting the relative positioning of the upper and lower image until they are in register. Features within the image or special alignment marks may be induced into the image supports to aid in the registration process. Once the images are in alignment pins may be used to hold them in the desired registration until the individual supports are secured. In a further embodiment, the image supports and transmission reflection device are held in position with a pressure platen with edge sealing and crimping taking place while under pressure.

The images of said imaging element may be formed by inkjet, thermal imaging, electrophotographic or optically exposed silver halide. The image formed by silver halide may be either black and white developed silver or color forming dyes. Any method of image exposure may be used. This includes conventional light devices such as tungsten or incandescent bulbs or by a collimated beam of light from a laser or CRT exposure. In another embodiment the image may be formed by any method of imparting indicia on a support. This includes lithographic, flexographic, gravure printing as well as drawing. The image may be of pictorial and or text composition. The upper and lower images may be formed by the same method or by a combination of methods.

The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The image receiving layer or IRL for ink jet imaging may be applied by any known methods. Such as aqueous or solvent coating, or melt extrusion coating techniques. The IRL is coated over the TL at a thickness ranging from 0.1–10 $\mu$m, preferably 0.5–5 $\mu$m. There are many known formulations which may be useful as dye receiving layers. The primary requirement is that the IRL is compatible with the inks which it will be imaged so as to yield the desirable color gamut and density. As the ink drops pass through the IRL, the dyes are retained or mordanted in the IRL, while the ink solvents pass freely through the IRL and are rapidly absorbed by the tie layer (TL). Additionally, the IRL formulation is preferably coated from water, exhibits adequate adhesion to the TL, and allows for easy control of the surface gloss.

For example, Misuda et al, in U.S. Pat. Nos. 4,879,166; 5,264,275; 5,104,730; 4,879,166; and Japanese patents 1,095,091; 2,276,671; 2,276,670; 4,267,180; 5,024,335; and 5,016,517 discloses aqueous based IRL formulations comprising mixtures of psuedo-bohemite and certain water soluble resins. Light in U.S. Pat. Nos. 4,903,040; 4,930,041; 5,084,338; 5,126,194; 5,126,195; 5,139,8667; and 5,147,717 discloses aqueous-based IRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable IRL formulations based on poly (vinyl alcohol). Iqbal in U.S. Pat. No. 5,208,092 discloses water-based IRL formulations comprising vinyl copolymers which are subsequently cross-linked. In addition to these examples, there may be other known or contemplated IRL formulations which are consistent with the aforementioned primary and secondary requirements of the IRL, all of which fall under the spirit and scope of the current invention.

The preferred IRL is a 0.1–10 $\mu$m IRL which is coated as an aqueous dispersion of 5 parts alumoxane and 5 parts poly (vinyl pyrrolidone). The IRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the IRL for the purpose of enhancing the durability of the imaged element. Such overcoats may be applied to the IRL either before or after the element is imaged. For example, the IRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention. Another preferred image receiving layer may comprise a mixture of 60% by weight lime-process ossein photographic grade gelatin, 30% by weight of polyvinylpyrrolidone (PVP K-90, ISP) and 10% by weight of Mordant 1 was prepared. Mordant 1 consists of a polymer prepared from (vinylbenzyl)trimethylammonium chloride and divinylbenzene as described in U.S. Pat. No. 6,045,917. The pH of the mixture was adjusted to 3.5 by addition of hydrochloric acid (36–38%, J T Baker). Some surfactant (Dixie 10G, Dixie Chemicals) was added to enhance costability. A 10% coating solution of the mixture was prepared and slot coated onto the support and dried at 100° C. to give a dry coverage of 5.4 g/m$^2$. For the image receiving layer, a mixture of 80% by weight of hydroxyethyl cellulose (Quatrisoft® LM200, Amerchol) and 20% by weight of methyl cellulose (Methocel® A4M, Dow Chemical) was prepared. Surfactants (Dixie® 10G, Dixie Chemicals and Zonyl® FSN, DuPont) were added to enhance coatability. A 2% coating solution of the mixture was prepared and slot coated onto the base layer and dried at 100° C. to give a dry coverage of 1.1 g/m$^2$.

There are a variety of printing processes that may be used to apply an image to a substrate. These include lithographic, flexographic, gravure printing, silk screening. Flexography is an offset letterpress technique where the printing plates are made from rubber or photopolymers. The flexography printing is accomplished by the transfer of ink from the raised surface of the printing plate to the surface of the material being printed. The rotogravure method of printing uses a print cylinder with thousands of tiny cells which are below the surface of the printing cylinder. The ink is transferred from the cells when the print cylinder is brought into contact with the material to be printed at the impression roll. Printing inks for flexography or rotogravure include solvent-based inks, water-based inks, and radiation cured inks. While rotogravure and flexography printing does provide acceptable image quality, these two printing methods require expensive and time-consuming preparation of print cylinders or printing plates which make printing jobs of less than 100,000 units expensive as the setup cost, and the cost of the cylinders and printing plates is typically depreciated over the size of the print job.

Recently, digital printing has become a viable method for the printing of information on packages. The term "digital printing" refers to the electronic digital characters or electronic digital images that can be printed by an electronic output device capable of translating digital information. The two main digital printing technologies are ink jet and electrophotography.

The introduction of piezo impulse drop-on-demand (DOD) and thermal DOD ink jet printers in the early 1980's provided ink jet printing systems. These early printers were very slow, and the ink jet nozzles often clogged. In the 1990's Hewlett Packard introduced the first monochrome ink jet printer, and, shortly thereafter, the introduction of color, wide format ink jet printers enabled businesses to enter the graphic arts market. Today, a number of different ink jet technologies are being used for packaging, desktop, industrial, commercial, photographic, and textile applications.

In piezo technology, a piezo crystal is electrically simulated to create pressure waves, which eject ink from the ink chamber. The ink can be electrically charged and deflected in a potential field, allowing the different characters to be created. More recent developments have introduced DOD multiple jets that utilize conductive piezo ceramic material which, when charged, increases the pressure in the channel and forces a drop of ink from the end of the nozzle. This allows for very small droplets of ink to form and be delivered at high speed at very high resolution, approximately 1,000 dpi printing.

Until recently, the use of color pigments in jet inks was uncommon. However, this is changing rapidly. Submicron pigments were developed in Japan for ink jet applications. Use of pigments allows for more temperature resistant inks required for thermal ink jet printers and laminations. Pigmented water-based jet inks are commercially available, and UV-curable jet inks are in development. Pigmented inks have greater lightfastness and water-resistance.

Digital ink jet printing has the potential to revolutionize the printing industry by making short-run, color print jobs more economical. However, the next commercial stage will require significant improvements in ink jet technology; the major hurdle remaining is to improve print speed. Part of this problem is the limitation of the amount of data the printer can handle rapidly. The more complex the design, the slower the printing process. Right now they are about ten times slower than comparable digital electrostatic printers.

Electrophotography was invented in the 1930's by Chester Carlson. By the early 1970's, the development of an electrophotographic color copier was being investigated by many companies. The technology for producing color copiers was already in place, but the market was not. It would take many more years until customer demand for color copies would create the necessary incentive to develop suitable electrostatic color copiers. By the late 1970's a few companies were using fax machines that could scan a document, reduce the images to electronic signals, send them out over the telephone wire and, using another fax machine, retrieve the electronic signals and print the original image using heat-sensitive papers to produce a printed copy.

In 1993 Indigo and Xeikon introduced commercial digital printing machines targeted on short-run markets that were dominated by sheet-fed lithographic printers. Elimination of intermediate steps associated with negatives and plates used in offset printing provides faster turnaround and better customer service. These digital presses share some of the characteristics of traditional xerography but use very specialized inks. Unlike inks for conventional photocopiers, these inks are made with very small particle size components in the range of 1 $\mu$m. Dry toners used in xerography are typically 8–10 $\mu$m in size.

In 1995 Indigo introduced the Ominus press designed for printing flexible packaging products. The Ominus uses a digital offset color process called One Shot Color that has six colors. A key improvement has been the use of a special white Electroink for transparent substrates. The Ominus web-fed digital printing system allows printing of various substrates using an offset cylinder that transfers the color image to the substrate. In principle, this allows perfect register regardless of the substrate being printed; paper, film, and metal can be printed by this process. This digital printing system is based on an electrophotographic process where the electrostatic image is created on the surface of a photoconductor by first charging the photoconductor by charge corona and exposing the photoconductive surface to a light source in image fashion.

The charged electrostatic latent image is then developed using ink containing an opposite charge to that on the image. This part of the process is similar to that of electrostatic toners associated with photocopying machines. The latent charged electrostatic image formed on the photoconductor surface is developed by means of electrophoretic transfer of the liquid toner. This electrostatic toner image is then transferred to a hot blanket, which coalesces the toner and maintains it in a tacky state until it is transferred to the substrate, which cools the ink and produces a tack-free print.

Electroinks typically comprise mineral oil and volatile organic compounds below that of conventional offset printing inks. They are designed so that the thermoplastic resin will fuse at elevated temperatures. In the actual printing process, the resin coalesced, the inks are transferred to the substrate, and there is no need to heat the ink to dry it. The ink is deposited on the substrate essentially dry, although it becomes tack-free as it cools and reaches room temperature.

For several decades a magnetic digital technology called "magnetography" has been under development. This process involves creating electrical images on a magnetic cylinder and using magnetic toners as inks to create the image. The potential advantage of this technology lies in its high press speed. Tests have shown that speeds of 200 meters per minute. Although these magnetic digital printers are limited to black and white copy, developments of color magnetic inks would make this high-speed digital technology economically feasible. The key to its growth will be further development of the VHSM (very high speed magnetic) drum and the color magnetic inks.

Within the magnetic digital arena, a hybrid system called magnetolithography has been built and tested on narrow web and short-run applications developed by Nipson Printing Systems in Belfort, France. The technology appears to provide high resolution, and tests have been conducted using a silicon-based, high density magnetographic head. Much more work is necessary in the ink development to bring this system to a competitive position relative to ink jet or electrophotography. However, the fact that it has high speed printing potential makes it an attractive alternate for packaging applications in which today's ink jet and electrophotography technologies are lagging.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers, such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which is designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12*a* North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The invention may be utilized with the materials disclosed in *Research Disclosure,* 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

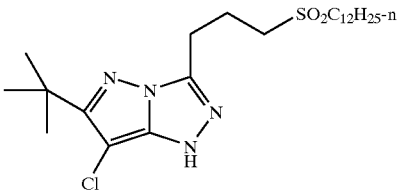

M-10

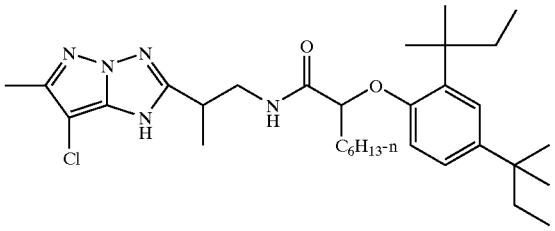

M-11

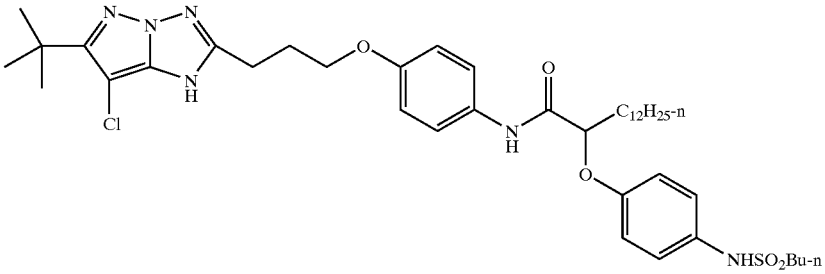

M-18

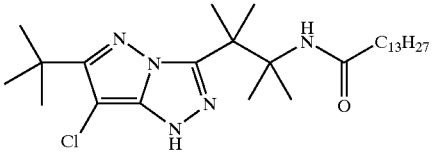

The element of the invention may contain an antihalation layer. A considerable amount of light may be diffusely transmitted by the emulsion and strike the back surface of the support. This light is partially or totally reflected back to the emulsion and reexposed it at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver between the emulsion and the support, (2) coating the emulsion on a support that contains either dye or pigments, and (3) coating the emulsion on a transparent support that has a dye to pigment a layer coated on the back. The absorbing material contained in the antihalation undercoat or antihalation backing is removed by processing chemicals when the photographic element is processed. The dye or pigment within the support is permanent and generally is not preferred for the instant invention. In the instant invention, it is preferred that the antihalation layer be formed of gray silver which is coated on the side furthest from the top and removed during processing. By coating furthest from the top on the back surface, the antihalation layer is easily removed during processing, as well as allowing exposure of the duplitized material from only one side. If the material is not duplitized, the gray silver could be coated between the support and the top emulsion layers. The problem of halation is minimized by coherent collimated light beam exposure, although improvement is obtained by utilization of an antihalation layer even with collimated light beam exposure.

In order to successfully transport individual imaging members of the invention prior to assembling the final composite picture element, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{13}$ ohm/square. A surface resistivity of the antistat coat at 50% RH is less than $10^{13}$ ohm/square has been shown to sufficiently reduce static fog in manufacturing and during photoprocessing of the image layers.

The invention photographic imaging members may contain matte beads to help aid in stacking, winding, and unwinding of the photographic members without damage. Matte beads are known in the formation of prior dislay imaging materials. The matte beads may be applied on the top or bottom of the imaging members. Generally, if applied on the emulsion side, the beads are below the surface protective layer (SOC).

In the following Table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12*a* North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating aids, addenda, etc. |
| 3 | I, II, III, IX A & B | |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Example 1

L1 Inkjet Formed Image
L2 102 μm Clear Polyester Base
L3 7.5 μm Polypropylene with 4% Anatase $TiO_2$ + Optical Brightener and Blue Tint
L4 20.3 μm Voided Polypropylene
L5 7.5 μm Clear Polypropylene
L6 InkJet Formed Image
L7 102 μm Clear Polyester Base This example consists of three separate supports. The upper image support (L1/L2) is a clear polyester base that was coated with an inkjet receiver layer. An ink jet image receiving layer was utilized to prepare the translucent display material of this example and was coated on the L1 polyethylene layer on the top biaxially oriented sheet. The ink jet image receiving layer was coated by means of an extrusion hopper, a dispersion containing 326.2 g of gelatin, 147 g of BVSME hardener, i.e., bis(vinylsulfonylmethyl) ether 2% solution in water, 7.38 g of a dispersion containing 2.88 g of polystyrene beads, 0.18 g of Dispex 30 (40% solution in water obtained from Allied Colloids, Inc.), and 4.32 g of water, and 3.0 g of a 20% solution in water of Surfactant 10G (nonylphenoxypolyglycidol) obtained from Olin Matheson Company. The thickness was about 5 micrometer (dried thickness).

Onto this layer was coated by means of an extrusion hopper an aqueous solution containing 143.5 g of a 3% solution in water of 4.42 g of hydroxypropyl cellulose (Methocel KLV100, Dow Chemical Company), 0.075 g of vanadyl sulfate, 2-hydrate obtained from Eastman Kodak Company, 0.075 g of a 20% solution in water of Surfactant 10G (nonylphenoxypolyglycidol) obtained from Olin Matheson Company, and 145.4 g of water; and 0.45 g of a 20% solution in water of Surfactant 10G (nonylphenoxypolyglycidol) obtained from Olin Matheson Company and 79.5 g of water to form an ink-receiving layer about 2 μm in thickness (dry thickness). An image was then printed into the image receiving layer using a Hewlett Packard Deskjet Cxi printer. The reflective and transmission device used in this example was coextruded and biaxially oriented. It is a separate support from L1/L2 and L6/L7. Table 1 below lists the characteristics of the layers of the biaxially oriented sheet used in this example. The device consists of 3 layers identified as L3, L4, and L5. L3 is tinted layer to which optical brightener and $TiO_2$ was added. The optical brightener used was Hostalux KS manufactured by Ciba-Geigy. Kronos 1014 $TiO_2$ (a 0.22 micrometer particle size $TiO_2$) was added to the L3 at 4% by weight of base polymer. A small quantity of blue tint ( Sheppard Blue 125A pigment) was added to achieve a transmission b* of −4.3. The L4 layer for the reflective and transmission device is microvoided by biaxially oriented and in polypropylene with 6% PBT (polybuytltherperlate) that aids in the voiding and further described in Table 2 where the refractive index and geometrical thickness is shown for measurements made along a single slice through the L3 layer; they do not imply continuous layers; a slice along another location would yield different but approximately the same thickness. The areas with a refractive index of 1.0 are voids that are filled with air and the remaining layers are polypropylene.

TABLE 1

| Layer | Material | Thickness, Micrometer |
|---|---|---|
| L3 | Polypropylene + $TiO_2$ + OB + Tint | 7.5 |
| L4 | Voided Polypropylene | 20.3 |
| L5 | Polypropylene | 7.5 |

The lower image support (L6/L7) is a clear polyester base that was coated with an inkjet receiver layer as describe above. An image was then printed into the image receiving layer using a Hewlett Packard Deskjet Cxi printer. The image is the same on for the upper and lower images.

Once the images are printed, the three separate supports are placed on top of each other in the order shown. The supports are placed on a light box and light is projected through the images. The relative positions of the upper and lower images are then adjusted until a good visual register is achieved. The composite imaging element is then placed in a clear polyolefin envelope and the open edges sealed by heat and pressure. The imaging element in the transparent sealed envelope is then placed in a backlite device consisting of a box, light source, a clear glass or plastic brace. A second clear brace is placed over top of the image element to hold it in the light box and to provide additional protection from the environment.

Example 2

| | |
|---|---|
| L1 | Clear polyolefin Envelope |
| L2 | inkjet Formed Image |
| L3 | 102 μm Clear Polyester Base |
| L4 | 1 μm Clear Polyethylene + Tint |
| L5 | 7.5 μm Polypropylene with 4% Anatase $TiO_2$ |
| L6 | 20.3 μm Voided Polypropylene |
| L7/L8 | 8.5 μm (2 layers of clear polypropylene) |
| L9 | inkjet Formed Image |
| L10 | 102 μm Clear Polyester Base |
| L11 | Clear polyolefin Envelope |

This example is similar to Example 1 except the reflection and transmission device has an added layer (L4), which is a medium density polyethylene layer, which contains the blue tint. A reduction in the level of tint is achieved because the color control is achieved in a much thinner layer. L7/L8 are clear layer of polypropylene. This device has an optical transmission of 50%. Other components of this example are essential identical to Example 1.

Example 3

| | |
|---|---|
| L1 | Clear polyolefin Envelope |
| L2 | 102 μm Clear Polyester Base |
| L3 | Developed/Process Dye Formed Image from Silver Halide Layer |
| L4 | 7.5 μm Polypropylene with 4% Anatase $TiO_2$ |
| L5 | 20.3 μm Voided Polypropylene |
| L6 | Developed/Process Dye Formed Image from Silver Halide Layer |

-continued

| | |
|---|---|
| L7 | 102 μm Clear Polyester Base |
| L8 | Clear polyolefin Envelope |

Example 3 is similar to Example 1 except the inkjet receiving layer is below the polyester layer. It this case a reverse image is formed during printing such that when it is viewed through the polyester sheet, it appears right reading. The lower image is formed or printed in the right reading mode;

Example 4

| | |
|---|---|
| L1 | Clear polyolefin Overlaminate |
| L2 | Electrophotographic Image formed by toners |
| L3 | 7.5 μm Polyester Layer with 5% Anatase $TiO_2$ + Tint + Optical Brightener |
| L4 | 20 μm Voided polyester Layer |
| L5 | Electrophotographic Image formed by toners |
| L6 | 102 μm Clear Polyester Base |
| L7 | Clear polyolefin Overlaminate |

L2, L3, L4 is image that has been formed on the surface of a reflective and transmission device that has an optical transmission of 47%. The device is a two layer sheet of polyester with a solid layer containing $TiO_2$, brightener, and blue tint. The types of additive are the same as used in Example 1.

Example 5

| | |
|---|---|
| L1 | Clear polyolefin Overlaminate |
| L2 | Processed and Developed Image from silver halide layer |
| L3 | 156 mg Gel and 150 mg Rutile $TiO_2$ with tint and optical brightener |
| L4 | Gel sub |
| L5 | Primer Layer |
| L6 | 54 μm Clear polyester |
| L7 | Conductive Antistat Layer |
| L8 | Processed and Developed Image from silver halide layer |
| L9 | Gel Sub |
| L10 | primer |
| L11 | 54 μm Clear Polyester Base |
| L12 | Conductive Antistat |
| L13 | Clear polyolefin Overlaminate |

Example 5 is prepared using two different polyester bases that have a processed and developed image. L2–L6 represent the upper imaging element which uses a 54 μm clear polyester base that is primed and gel subbed for better adhesion for photographic layers. Under the image is a layer (L3) that is mage from gelatin and $TiO_2$. Added to this layer are a blue tint (Tintayd WD 2228) and an optical brightener (Tinivan). On the bottom side (L7) there is an antistat layer to minimize static and dirt problems. The antistatic layer contains conjugated polymers, semiconductive metal halide salts, semiconductive metal oxide particles. Silver halide emulsion is coated, exposed and then developed to form an image. In this example a three-color dye forming coupler emulsion was used. Black and White or other light sensitive emulsions may be used to form the desired image. The lower imaged layer is a primed and gel subbed clear polyester base with an image formed by exposing and processing a light sensitive silver halide emulsion. The two images are brought into alignment and then locked and sealed into permanent alignment using a polyolefin laminate. The sealed composite picture is then placed in a backlite picture frame for display.

Coating format 1 was utilized to prepare photographic composite day/night display materials and was coated on the two control materials and the invention. For the invention, Coating Format 1 was coated on the L1 polyethylene layer on the top biaxially oriented sheet.

| | Coating Format 1 | Laydown mg/m$^2$ |
|---|---|---|
| Layer 1 | Blue Sensitive Layer | |
| | Gelatin | 1300 |
| | Blue sensitive silver (Blue EM-1) | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive Layer | |
| | Gelatin | 1100 |
| | Green sensitive silver (Green EM-1) | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

APPENDIX

Y-1

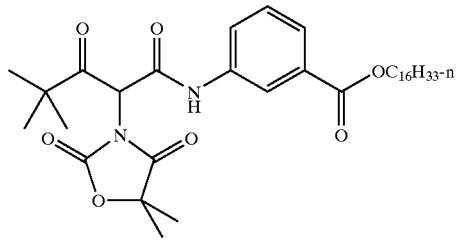

ST-1 = N-tert-butylacrylamide/n-butyl acrylate copolymer (50:50)
S-1 = dibutyl phtalate

SC-1

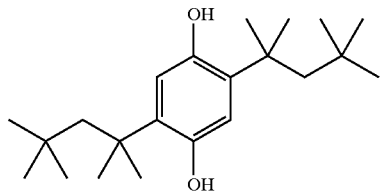

M-1

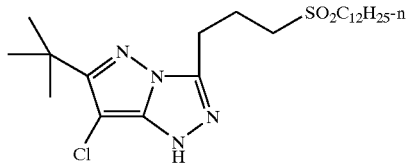

S-2 = diundecyl phtalate

ST-2

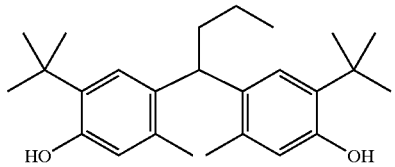

ST-3

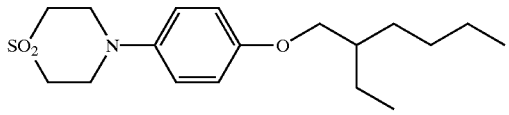

ST-4

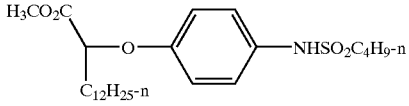

UV-1

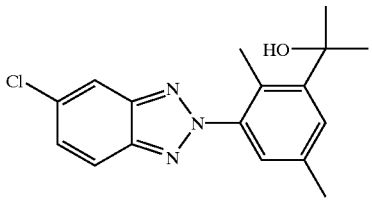

-continued

UV-2

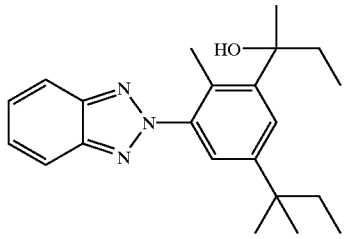

S-3 = 1,4-Cyclohexyldimethylene bis(2-ethylhexonate)

C-1

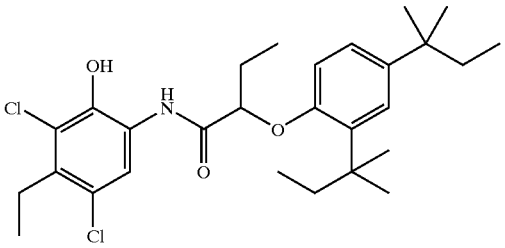

S-4 = 2-(2-Butoxyethoxy)ethyl acetate

Dye 1

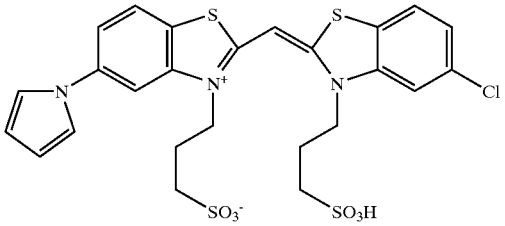

The invention has been described in detail with particular reference to certain preferred embodiments thereof, but it will be understood that variations and modifications can be effected within the spirit and scope of the invention.

What is claimed is:

1. An imaging element comprising in order an upper image, at least one transmission and reflection device providing optical transmission of said element of between 35% to 55% and a lower image, wherein at least the upper and lower images are on separate supports; wherein said upper image, said lower image, and said at least one transmission and reflective device are all held together, and said upper image and said lower image are in register with each other; the imaging element thereby providing a bright, sharp reflective image and allowing for backlighting of the image to also result in a clear, sharp image in low light situations.

2. The imaging element of claim 1 wherein said upper image is on a substantially transparent support.

3. The imaging element of claim 1 wherein said lower image is on a substantially transparent support.

4. The imaging element of claim 1 wherein said upper image is on a transmission and reflective support.

5. The imaging element of claim 1 wherein said lower image is on a transmission and reflective support.

6. The imaging element of claim 2 wherein said lower image is on a substantially transparent support.

7. The imaging element of claim 4 wherein said lower image is on a transmission and reflective support.

8. The imaging element of claim 1 wherein said upper image and lower image are images of the same scene.

9. The imaging element of claim 1 further comprising a substantially transparent layer between said upper image and said lower image.

10. The imaging element of claim 8 wherein said upper and lower image are held in register by fusing said image supports and reflection and transmission device.

11. The imaging element of claim 8 wherein said upper and lower image are held in register by crimping said image supports and reflection and transmission device.

12. The imaging element of claim 8 wherein said upper and lower image are held in register by adhesively connecting said image supports and reflection and transmission device.

13. The imaging element of claim 8 wherein said upper and lower image are held in register by placing said image supports and reflection and transmission device in a transparent container.

14. The imaging element of claim 1 wherein said at least one transmission and reflection device comprises a voided polymer sheet.

15. The imaging element of claim 8 wherein said at least one transmission and reflection device comprises a pigmented polymer sheet.

16. The imaging element of claim 14 wherein said at least one transmission and reflection device further comprises pigment.

17. The imaging element of claim 1 wherein said at least one transmission and reflection device comprises a paper.

18. The imaging element of claim 1 wherein said at least one transmission and reflection device comprises tinting agents.

19. The imaging element of claim 1 wherein said at least one transmission and reflection device comprises optical brighteners.

20. The imaging element of claim 1 wherein said at least one transmission and reflection device comprises glass.

21. The imaging element of claim 1 wherein at least one of said upper and lower image comprises an image formed by ink jet.

22. The imaging element of claim 1 wherein at least one of said upper and lower image comprises an image formed by thermal imaging.

23. The imaging element of claim 1 wherein at least one of said upper and lower image comprises an image formed by electrophotographic imaging.

24. The imaging element of claim 1 wherein at least one of said upper and lower image comprises an image formed by optically exposed silver halide.

25. The imaging element of claim 1 wherein at least one of said upper and lower image comprises an image formed by lithographic printing.

26. The imaging element of claim 1 wherein said optical transmission is between 40 to 50%.

27. A method of forming an imaging element comprising providing an upper image, providing at least one transmission and reflection device providing optical transmission of said element of between 35% and 55%, and providing a lower image, wherein at least the upper and lower images are on separate supports, bringing said upper image, lower image, and at least one transmission and reflective device into register and securing them together; the imaging element thereby providing a bright, sharp reflective image and allowing for backlighting of the image to also result in a clear, sharp image in low light situations.

28. The method of claim 27 wherein said upper image, lower image, and at least one transmission and reflection device are placed in register by use of pins.

29. The method of claim 27 wherein said upper image, lower image, and at least one transmission and reflection device are placed in register and held in place by use of pressure platens with edge sealing or crimping taking place while held under pressure.

30. The imaging element of claim 13 wherein said transparent container is sealed.

31. The imaging element of claim 13 wherein said transparent container provides environmental protection.

32. The method of claim 27 wherein said at least one transmission and reflection device comprises a voided polymer sheet.

33. The imaging element of claim 8 wherein said at least one transmission and reflection device comprises a voided polymer sheet.

* * * * *